US006972519B2

(12) United States Patent
Custodis et al.

(10) Patent No.: US 6,972,519 B2
(45) Date of Patent: Dec. 6, 2005

(54) IMAGE DISPLAY DEVICE COMPRISING A PLURALITY OF SILENT GAS DISCHARGE LAMPS

(75) Inventors: Udo Custodis, Munich (DE); Michael Seibold, Munich (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 243 days.

(21) Appl. No.: 10/450,902

(22) PCT Filed: Nov. 15, 2001

(86) PCT No.: PCT/DE01/04282

§ 371 (c)(1),
(2), (4) Date: Jun. 19, 2003

(87) PCT Pub. No.: WO02/50807

PCT Pub. Date: Jun. 27, 2002

(65) Prior Publication Data

US 2004/0061420 A1 Apr. 1, 2004

(30) Foreign Application Priority Data

Dec. 20, 2000 (DE) ..... 100 63 931

(51) Int. Cl.[7] ..... H01J 17/49
(52) U.S. Cl. ..... 313/586; 313/491
(58) Field of Search ..... 313/483–485, 313/581–587, 607, 234, 491; 315/169.1, 315/169.3

(56) References Cited

U.S. PATENT DOCUMENTS

| | | | | |
|---|---|---|---|---|
| 4,907,862 | A | 3/1990 | Suntola | |
| 5,461,397 | A | 10/1995 | Zhang et al. | |
| 5,479,071 | A | 12/1995 | Lynn | |
| 6,060,828 | A * | 5/2000 | Vollkommer et al. | 313/607 |
| 6,340,862 | B1 * | 1/2002 | Lecheler et al. | 313/484 |

FOREIGN PATENT DOCUMENTS

| | | |
|---|---|---|
| DE | 198 45 228 | 4/2000 |
| EP | 0 604 902 | 7/1994 |
| EP | 0 926 705 | 6/1999 |
| WO | 00/19485 | 4/2000 |
| WO | 00/79334 | 12/2000 |

* cited by examiner

*Primary Examiner*—Joseph Williams
(74) *Attorney, Agent, or Firm*—Robert F. Clark

(57) ABSTRACT

The invention relates to a preferably large-format image display device that is constructed from a plurality of individual silent gas discharge lamps.

8 Claims, 3 Drawing Sheets

IMAGE DISPLAY DEVICE COMPRISING A PLURALITY OF SILENT GAS DISCHARGE LAMPS

BACKGROUND OF THE INVENTION

This invention relates to an image display device constructed from silent gas discharge lamps. Silent gas discharge lamps are known per se, and by definition have a dielectric layer between at least the anode(s) and the discharge medium, although in the bipolar case all the electrodes have dielectric barriers.

Silent discharge lamps are known per se. They are advantageous for various applications, including in particular the backlighting of displays in flat screens, etc. For this field of application, construction as a so-called flat panel lamp is known, in which the lamp consists essentially of two plane-parallel plates that can be connected via a frame and enclose the discharge medium between them. One of the two plates is in this case used as the light emission surface of the flat panel lamp.

These silent gas discharge lamps are preferably operated with a pulsed operating method, with which a particularly high efficiency can be achieved in the generation of light (UV light or, preferably, visible light when luminescent materials are used). The specifics of this operating method are also prior art and are familiar to the person skilled in the art, so that details need not be entered into here.

It is furthermore known to use, in a silent gas discharge lamp, an electrode arrangement divided into several groups, wherein the groups can be operated separately from one another. In this way, for example, it is possible to illuminate different areas of an instrument arrangement independently of one another, and to switch this illumination on and off for the different areas, with only one lamp being used in total. In this case, the various areas of the instrument illumination may be colored differently, i.e. luminescent materials or luminescent mixtures having different colors may be used. Reference is made to EP 97 122 799.6.

SUMMARY OF THE INVENTION

It is a technical object of the present invention to provide a novel application possibility for silent discharge lamps.

To that end, the invention relates to an image display device comprising a plurality of gas discharge lamps, respectively having a discharge vessel filled with a gas fill, at least two electrodes, a dielectric layer between at least one of the electrodes and the gas fill, and a luminescent layer, wherein the gas discharge lamps are arranged next to one another in a plane to form a surface, and the image display is colored and the gas discharge lamps can emit different colors.

Preferred embodiments are indicated in the dependent claims.

The basic idea of the invention involves not using the individual silent discharge lamp as a backlighting lamp for a display, as is conventionally done, but instead making an element of the actual image display from the discharge lamp itself. To that end, an image display device, i.e. a display, is to be constructed from a plurality of silent gas discharge lamps arranged next to one another in a plane and, by colored operation of the silent discharge lamps, it should be possible to produce not only monochrome image information, but rather a color image formed from at least two, preferably three, primary colors. In this case, on the one hand it is conceivable for the individual discharge lamps to form respective monochrome pixels and for a multicolor image display to be made possible overall by a set of differently colored pixels arranged next to one another.

However, the case in which the individual gas discharge lamp can already represent the color spectrum of the display and hence functions as a full color pixel (with two or three primary colors) is preferred. The spatial resolution of the display is then of the order of the dimensions of the individual discharge lamp, or better. Indeed, it is also possible for the individual discharge lamp to form not just one, but several full color pixels, if it is itself spatially subdivided and contains respective full color pixels in different elementary surfaces arranged next to one another. This is a question of separate operability of subregions of the discharge lamp and, with cost-effective manufacture of large-format silent discharge lamps, it may be more advantageous than a correspondingly larger number of smaller-format lamps.

With regard to the individual discharge lamp, reference is firstly made to a simultaneous parallel application by the same Applicant, entitled "Stille Entladungslampe mit steuerbarer Farbe" [silent discharge lamp with controllable color], the disclosure of which is hereby cited. In brief, said patent shows how, by subdividing the electrode set in the discharge lamp, it is possible to create separately operable electrode groups, which are respectively assigned to differently colored elementary luminescent surfaces. Therefore, by selective or incrementally simultaneous operation of the various electrode groups, it is possible to emit a color spectrum of the luminescent colors from the elementary luminescent surfaces and the color mixtures that can be produced therefrom. In this case, the elementary luminescent surfaces should be interleaved in such a way that essentially uniform light emission is obtained overall with each elementary luminescent surface, i.e. illumination of essentially the entire light emission surface of the pixel in question. This pixel may, however, correspond to a subregion of the overall light emission surface of the lamp, in which case the corresponding elementary luminescent surfaces and electrode groups only need to be interleaved within this subregion.

The two or more pixels, which are inside the same lamp in this case, naturally need to be operable independently of one another, in order to function overall as separate pixels so that, on the one hand, through the primary color allocation and, on the other hand, through the large number of pixels, a complex group structure can be obtained inside the lamp. Also, as explained in more detail in the cited parallel application, owing to the necessary dimming operation of the individual groups to produce continuous color mixtures, it may be expedient to provide electrode subgroups with different discharge gaps within each individual group, so that it is possible to operate with particularly small powers.

Overall, it is hence possible to construct a color display with individual gas discharge lamps by time-varying multicolored operation (of a lamp or a set of neighboring lamps). In another variant of the invention, the multicolor generation inside a single pixel may also take place according to a principle which has already been put forward in a prior, as yet unpublished patent application having the official file reference D 199 27 791.5 (associated PCT/DE 00/01823) with regard to the backlighting of an LCD display. According thereto, the gas discharge lamp can be operated in a sequentially timed way with successive colors, the frequency of the color generation being so high that the human eye actually perceives a corresponding color mixture. To that end, as explained in more detail in the cited application, several electrode groups, which are sequentially operated, may in turn be provided inside a gas discharge lamp, or a plurality of discharge lamps that are respectively assigned to the individual colors, and are to be operated sequentially overall, may be provided.

In the aforementioned application in the context of a large image display device having a plurality of such discharge lamps, the LCD display arranged in front (which is described in the cited application) is superfluous because the sequential operation is basically intended to produce only the chromaticity of an image pixel. This can be done just by controlling the power of the individual primary colors, without an additional contribution needing to be made by an LCD display or other brightness filter. Naturally, however, it is also possible to work with such a display, so that the spatial resolution can be greatly increased, although the costs rise significantly. In this context, the image display device according to the invention might hence consist of a parallel connection of individual LCD displays according to the cited application 199 27 791.5.

The invention will be explained in more detail below with the aid of exemplary embodiments that are represented in the figures. In the preceding description, as well as the description below, the disclosed features are to be taken both in the context of the device category and in the context of the method category.

DETAILED DESCRIPTION OF THE INVENTION

Figure 1:
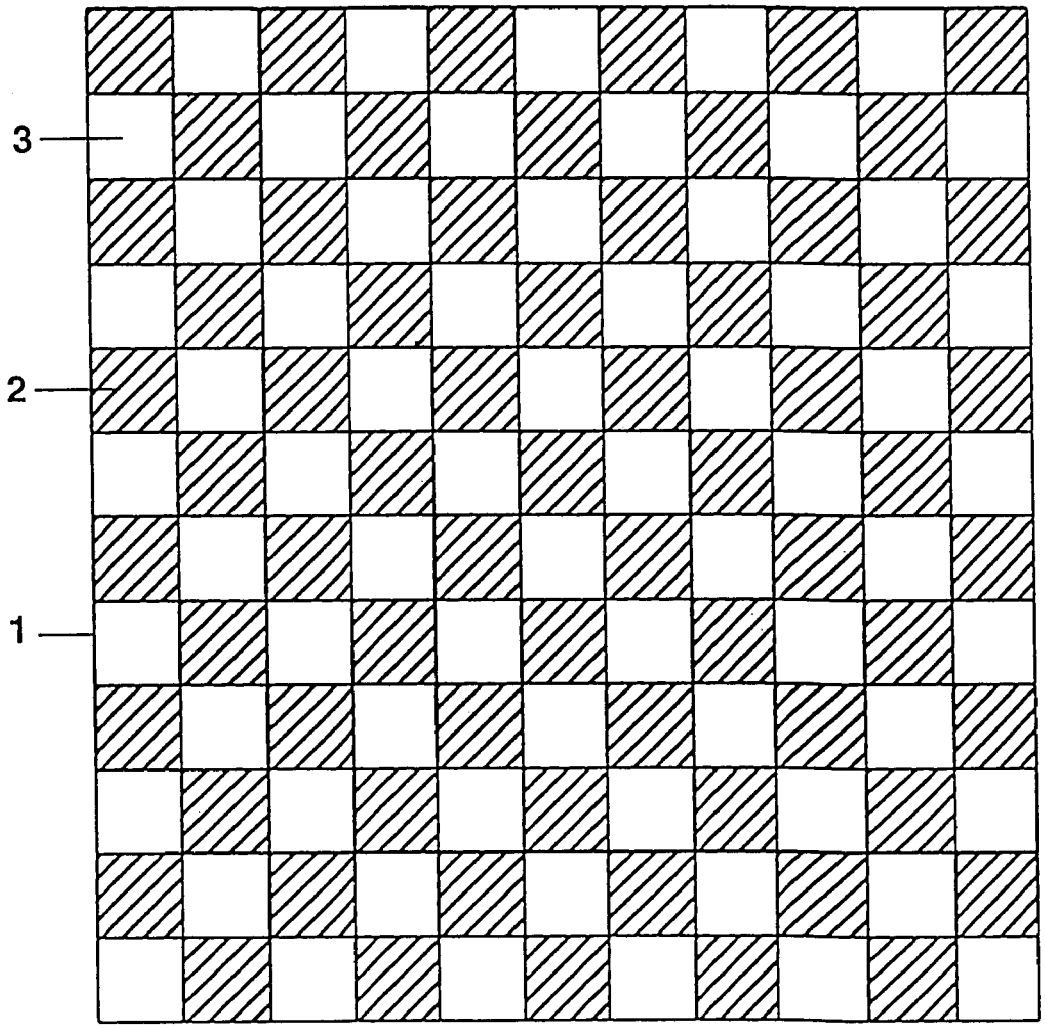
FIG. 1 schematically shows the structure of a light emission surface of a silent discharge lamp having two elementary luminescent surfaces that each correspond to primary colors.

FIG. 1 schematically shows the flat structure of a light emission surface 1 of a silent gas discharge lamp. In this case, the light emission surface 1 corresponds essentially to the optically transmissive cover plate of a silent flat panel lamp that is conventional apart from the details explained below. It can be seen that the light emission surface 1 is divided in a checkerboard pattern into two elementary luminescent surfaces 2 and 3. The elementary luminescent surfaces 2 and 3 are in this case to be understood as being the sum of the respective light and dark squares, each elementary luminescent surface 2 and 3 hence forming half of the light emission surface and being capable, even when activated on its own, of illuminating the light emission surface 1 essentially fully. Owing to the relatively fine checkerboard-pattern interleaving between the elementary luminescent surfaces 2 and 3, at a certain observation distance the eye can here no longer distinguish which of the elementary luminescent surfaces 2 or 3 is excited to emit light. Naturally, this does not apply to the different colors that are provided by the luminescent materials or luminescent mixtures of the elementary luminescent surfaces 2 and 3. In this example, the elementary luminescent surface 2 is intended to emit a blue hue and the elementary luminescent surface 3 is intended to emit a yellow hue. Hence, besides the hues blue and yellow, it is thereby also possible to represent hues in a continuous green spectrum that results from mixing the two primary colors.

The uniformity can be further enhanced by also interposing, in front of the discharge lamp, a diffuser element that is known per se for smoothing the light density distribution in display screen backlighting systems, for example a prism film or a matt sheet.

Figure 2:
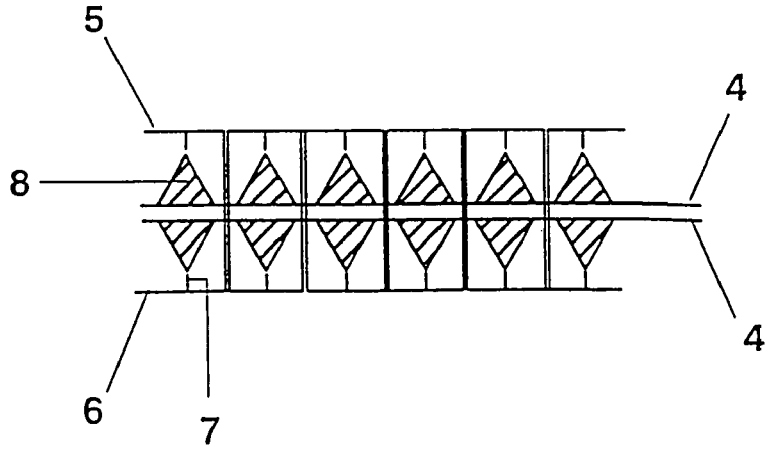
FIG. 2 schematically illustrates a suitable electrode structure for this.

FIG. 2 shows an example of an electrode structure suited to FIG. 1. The two central horizontal lines 4 correspond in this case to two anodes, and the electrode strips 5 and 6 meandering, so to speak, at right angles around these anodes 4 are cathodes that can be separately operated from one another, each with projections 7 for localizing individual discharge structures 8. The cathode 5 is illustrated by broken lines, so as to distinguish it from the cathode 6; naturally, however, it is in fact a continuous track.

The separate operability of the cathodes 5 and 6 creates two electrode groups 4, 5 and 4, 6 (with common anodes), to which the discharge structures schematically indicated as respective triangles are assigned. In the figure, simultaneous operation of both electrode groups is hence assumed.

It is self-evident that the electrode strips 4, 5, 6 need to be insulated from one another at the intersection points and in the regions where they pass relatively close to one another. To that end, a corresponding safety distance (not pictorially represented in FIG. 2) may be provided between the cathode strips 5 and 6, in particular, in the neighboring regions.

It is self-evident that the squares that are respectively enclosed between the cathodes 5 and 6 and the anodes 4, and in which the individual discharge structures 8 are located, are arranged directly under the individual squares of the elementary luminescent surfaces 2 and 3 in the lamp. In this way, the electrode groups 4, 5 and 4, 6 are respectively assigned to one of the two elementary luminescent surfaces 2 and 3. Depending on the size of the individual squares, and as a function of the distance between the discharge structures 8 and the elementary luminescent surfaces (perpendicular to the plane of the drawing as shown in the figures), when one of the two electrode groups 4, 5 and 4, 6 is in operation, some degree of excitation of the other elementary luminescent surface not actually assigned to it will naturally also occur. This slightly impairs the purity of the primary colors when only one of the two electrode groups 4, 5 and 4, 6 is being operated, but it does not fundamentally change the basic principle of the representability of all color mixtures between the primary colors that can be represented.

Figure 3:
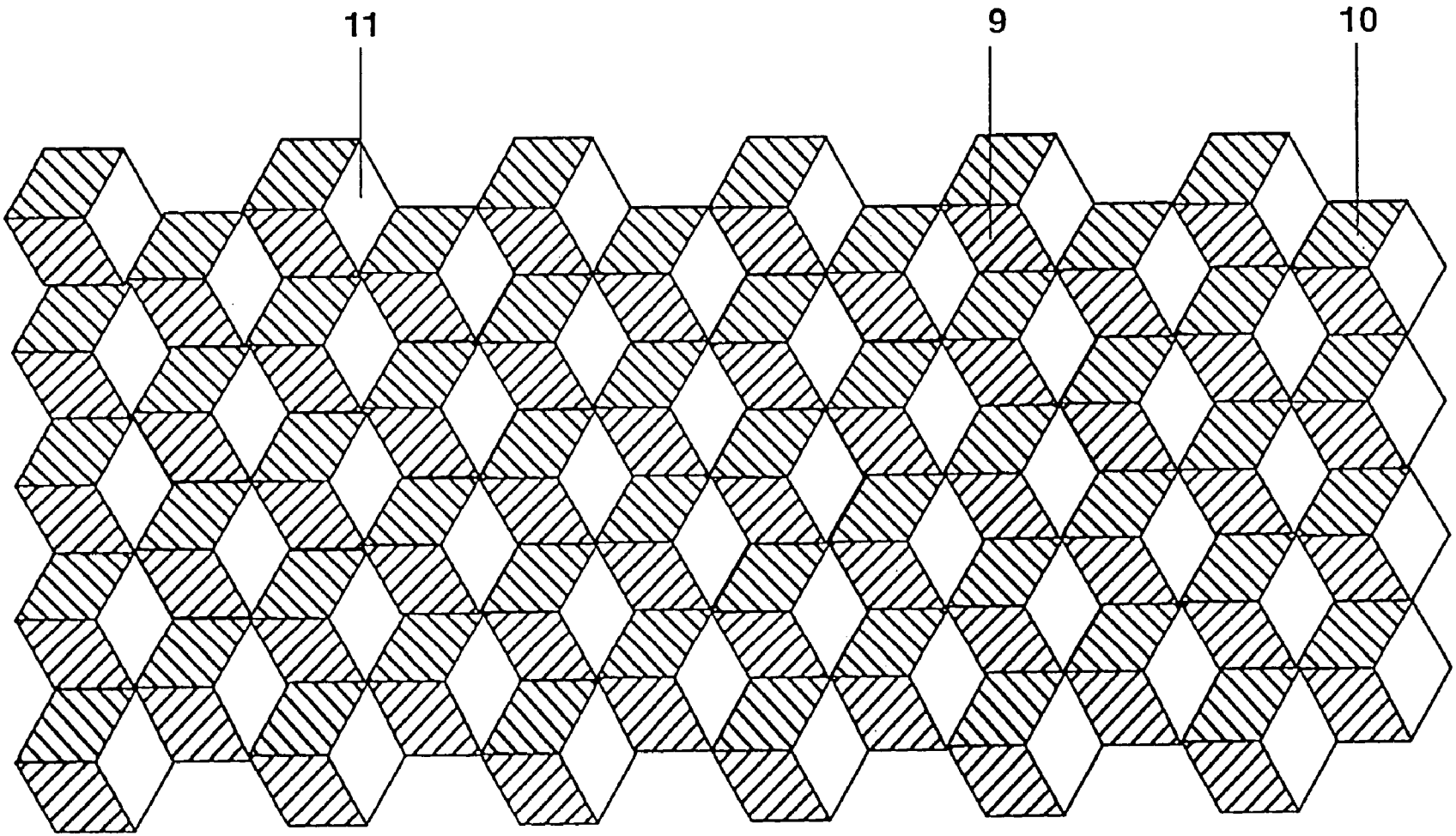
FIG. 3 illustrates the structure of a variant of FIG. 1, namely the interleaving of three elementary luminescent surfaces that each correspond to primary colors.

FIG. 3 shows a variant of the pattern in FIG. 1, which is configured for three primary colors. The elementary luminescent surfaces are denoted 9, 10 and 11, and in this variant correspond to the primary colors blue at 9, green at 10 and red at 11. A correspondingly constructed discharge lamp is therefore in principle capable of displaying a full color spectrum. In other respects, the comments about FIG. 1 apply. The electrode structure needed for the variant in FIG. 3 is naturally somewhat more complex than the one represented in FIG. 2, and will not be explained in detail here because nothing fundamentally new comes from it.

Figure 4:
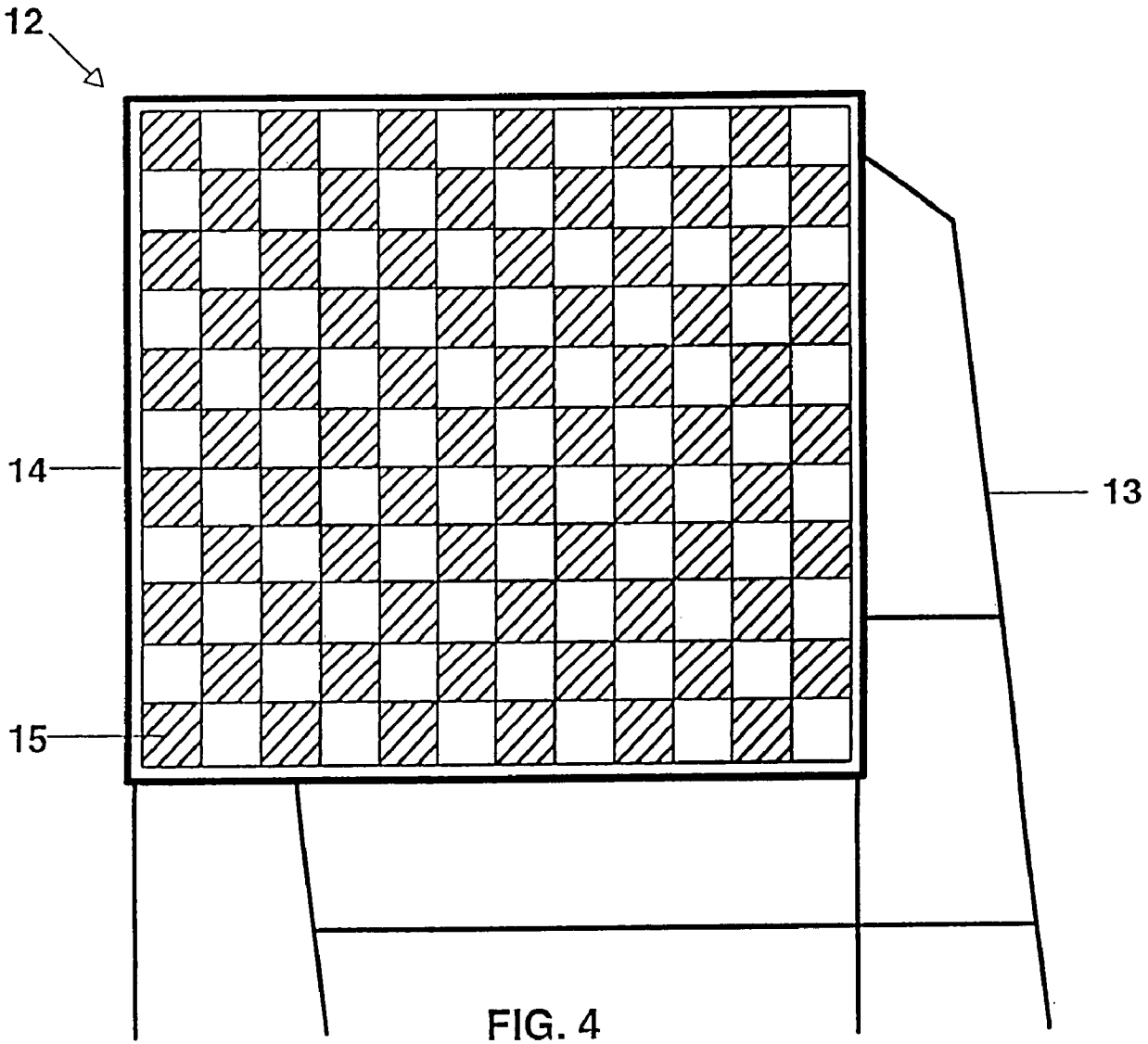
FIG. 4 schematically illustrates an image display device according to the invention that can be constructed from silent gas discharge lamps according to FIGS. 1–3.

FIG. 4 schematically shows a large-format image display device 12 with a stand 13 which supports a large-format rectangular flat display screen wall 14 so that it is upright and raised above the ground. Such an image display device 12 could, for example, be used as an information screen in a large sports stadium or could be mounted, for example, as an advertising panel on house walls, in the latter case naturally without the stand 13 shown here.

The flat display screen wall 14 consists essentially of a large number of individual gas discharge lamps 15, which are mounted next to one another in a plane and are constructed according to FIGS. 1 and 2 or according to FIG. 3. In this way, they form full color pixels for a color representation with two or three primary colors, respectively. The graphical image information (i.e. light/dark information) in this case has a spatial resolution corresponding to the size of the individual gas discharge lamps 15. The flat display screen wall 14 should hence be configured in such a way that, at an acceptable observation distance, the observer can overall see an image and preferably no longer perceives the individual lamps per se.

Alternatively, the image display device 12 in FIG. 4 may be constructed from the respectively monochrome, but differently colored gas discharge lamps 15. In the checkerboard arrangement represented in FIG. 4, this corresponds to a pattern of the primary colors in FIG. 1, but with the individual square or rectangle now corresponding no longer to a very small luminescent spot, but rather to a complete gas discharge lamp. It is, naturally, also possible to use an arrangement adapted to three primary colors, as for instance in FIG. 3, in which case the individual gas discharge lamps 15 may also have a shape other than a rectangular shape (in FIG. 3, specifically, as parallelograms with 60° and 120° angles). Further, it is naturally possible to operate the individual discharge lamps 15 in FIG. 4 in a sequentially timed way, in order to obtain overall (and as a time average) a full color representation with each individual lamp 15. In this case, the graphical image information may be obtained either by controlling the power of the individual lamps 15 or by additional use of an LCD filter, for instance, although this significantly increases the costs.

The comment already made in the introduction to the description moreover applies, that by subdividing the individual lamps, it is also possible to achieve a higher spatial resolution of the graphical representation and the color representation than that which corresponds to the individual lamp size. This is essentially a question of economics, that is to say depending on whether a set of smaller lamps or a larger lamp that corresponds to the format of the full set, but is subdivided, is more cost-effective to manufacture.

An essential advantage of using silent discharge lamps for image display devices 12, as in FIG. 4, is that a very high light density can be achieved using the silent discharge lamps with an acceptable consumption of electricity. Furthermore, silent discharge lamps are extraordinarily switch-proof, i.e. well suited to time-varying continuous applications. They also exhibit virtually no start-up behaviour or temperature dependency of the luminous power. These advantages are particularly suitable for applications of such image display devices in sports stadiums, for concert broadcasts, in advertising, in traffic control systems and in all other applications for which large-format image representation is important.

What is claimed is:

1. An image display device(12) comprising a plurality of gas discharge lamps (15), respectively having a discharge vessel filled with a gas fill, at least two electrodes (4, 5, 6), a dielectric layer between at least one of the electrodes (4) and the gas fill, and a luminescent layer (2, 3, 9, 10, 11), wherein the gas discharge lamps (15) are arranged next to one another in a plane to form a surface (14), and the image display (12) is colored and each gas discharge lamp (15) respectively forms a full color pixel, the electrodes (4, 5, 6) are subdivided into separately operable electrode groups (4, 5; 4, 6), the luminescent layer (2, 3, 9, 10, 11) is subdivided into differently colored elementary luminescent surfaces, the differently colored elementary luminescent surfaces (2, 3; 9, 10, 11) are assigned to the separately operable electrode groups (4, 5; 4, 6), characterized in that the elementary luminescent surfaces and electrode groups are interleaved in such a way that illumination of essentially the entire light emission surface of the gas discharge lamp in question can be obtained overall with each electrode group.

2. The image display device (12) as claimed in claim 1, in which the gas discharge lamps (15) are respectively configured for sequentially timed operation with successive colors.

3. The image display device (12) as claimed in claim 1, in which the gas discharge lamps (15) are respectively configured for simultaneous operation of the individual colors.

4. The image display device (12) as claimed in claim 1, in which each gas discharge lamp (15) forms a multiple full color pixel.

5. The image display device (12) as claimed in claim 1, in which the light/dark image information of the image display is formed by the respective powers of the color emissions of the gas discharge lamps (15) themselves.

6. The image display device (12) as claimed in claim 1, in which a brightness filter (15) is placed in front of the gas discharge lamps.

7. The image display device (12) as claimed in claim 6, in which the brightness filter has LCD elements.

8. The image display device (12) as claimed in claim 2, further comprising a brightness filter with LCD elements in front of the gas discharge lamps, and a planar arrangement of a plurality of display devices (15), which respectively have an LCD display and a gas discharge lamp (15) that successively emits color in a timed sequence.

* * * * *